US011087694B2

(12) United States Patent
Park

(10) Patent No.: US 11,087,694 B2
(45) Date of Patent: Aug. 10, 2021

(54) DRIVING VOLTAGE SENSING CIRCUIT AND DISPLAY DEVICE USING THE SAME

(71) Applicant: LG Display Co., Ltd., Seoul (KR)

(72) Inventor: KwangMo Park, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 31 days.

(21) Appl. No.: 16/673,650

(22) Filed: Nov. 4, 2019

(65) Prior Publication Data

US 2020/0143753 A1 May 7, 2020

(30) Foreign Application Priority Data

Nov. 7, 2018 (KR) ..... 10-2018-0135784

(51) Int. Cl.
*G09G 3/3291* (2016.01)

(52) U.S. Cl.
CPC ..... *G09G 3/3291* (2013.01); *G09G 2320/043* (2013.01)

(58) Field of Classification Search
CPC ..... G09G 3/3233; G09G 2320/045; G09G 3/3208; G09G 3/30
See application file for complete search history.

(56) References Cited

U.S. PATENT DOCUMENTS

2010/0214273 A1* 8/2010 Shirouzu ..... G09G 3/30 345/205
2014/0084792 A1* 3/2014 Oh ..... G09G 3/00 315/120
2015/0187274 A1* 7/2015 Kim ..... G09G 3/3291 345/212
2019/0156753 A1* 5/2019 Yang ..... G09G 3/3258

* cited by examiner

*Primary Examiner* — Yuzhen Shen
(74) *Attorney, Agent, or Firm* — Seed IP Law Group LLP

(57) ABSTRACT

A driving voltage sensing circuit and a display device including the same. Deterioration of an organic light-emitting diode (OLED) disposed in each of subpixels is effectively compensated for by accurately sensing a change of charged capacitance depending on a current flowing through the organic light-emitting diode in a deterioration sensing period of the organic light-emitting diode. A driving voltage-for-sensing deterioration, applied to the display panel in the deterioration sensing period of the organic light-emitting diode, is maintained within a reference range. The deterioration of the organic light-emitting diode is accurately sensed by maintaining the driving voltage-for-sensing deterioration, applied in the deterioration sensing period, within the reference range.

13 Claims, 14 Drawing Sheets

DRIVING VOLTAGE SENSING CIRCUIT AND DISPLAY DEVICE USING THE SAME

CROSS REFERENCE TO RELATED APPLICATION

This application claims priority to Korean Patent Application No. 10-2018-0135784, filed on Nov. 7, 2018, which is hereby incorporated by reference for all purposes as if fully set forth herein.

BACKGROUND

Technical Field

Exemplary embodiments relate to a driving voltage sensing circuit and a display device using the same.

Description of the Related Art

With the development of the information society, there has been increasing demand for a variety of image display devices. In this regard, a range of display devices, such as liquid crystal display (LCD) devices and organic light-emitting diode (OLED) display devices, have recently come into widespread use.

Among such display devices, OLED display devices have superior properties, such as rapid response speeds, high contrast ratios, high luminous efficiency, high luminous intensity, and wide viewing angles, since self-emissive organic light-emitting diodes (OLEDs) are used.

Such an OLED display device may include OLEDs disposed in a plurality of subpixels arrayed in a display panel, and may control the OLEDs to emit light by controlling current flowing through the OLEDs, so as to display an image while controlling luminous intensities of the subpixels.

OLEDs, included in the plurality of subpixels, may experience deterioration over time. Due to such deterioration, luminous intensities intended to be expressed using the subpixels may not be accurately expressed. Accordingly, it is beneficial to measure and compensate the deterioration of the OLEDs, included in the subpixels, respectively.

In order to accurately determine deterioration of the OLEDs, a driving voltage-for-sensing deterioration for determining deterioration is maintained at a lower level than a driving voltage during an image driving period. However, when the driving voltage-for-sensing deterioration is changed due to any other factors, e.g., deviations among components of a driving voltage supply circuit, the driving voltage-for-sensing deterioration may also be influenced. In this case, it may be difficult to accurately determine the deterioration of the OLEDs.

BRIEF SUMMARY

Various aspects of the present disclosure provide a display panel and a display device able to accurately sense deterioration of an organic light-emitting diode (OLED) disposed in each of subpixels of the display panel and compensate for deterioration.

Also provided are a driving voltage sensing circuit able to improve the accuracy of deterioration sensing of the organic light-emitting diode by maintaining a driving voltage-for-sensing deterioration within a reference range in a deterioration sensing period of the organic light-emitting diode, and a display device including the driving voltage sensing circuit.

According to an aspect of the present disclosure, a display device may include: a display panel in which a plurality of gate lines, a plurality of data lines, and a plurality of subpixels are disposed; a gate driver circuit driving the plurality of gate lines; a data driver circuit driving the plurality of data lines; a driving voltage sensing circuit sensing whether or not a driving voltage-for-sensing deterioration supplied to the display panel is outside of an reference range and outputting a driving voltage sensing signal according to a result of the sensing; and a timing controller controlling a power management integrated circuit supplying the driving voltage-for-sensing deterioration, in response to the driving voltage sensing signal transferred from the driving voltage sensing circuit.

Each of the plurality of subpixels may include: an organic light-emitting diode; a driving transistor driving the organic light-emitting diode, and having the driving voltage-for-sensing deterioration supplied thereto; a switching transistor electrically connected between a gate node of the driving transistor and a corresponding data line among the plurality of data lines; and a sensing transistor electrically connected between a source node or a drain node of the driving transistor and a reference voltage line.

The driving voltage sensing circuit may sense the driving voltage-for-sensing deterioration supplied to the display panel in a deterioration sensing period in which deterioration of the organic light-emitting diode is sensed.

The reference range may correspond to a range between a highest value of the driving voltage-for-sensing deterioration and a lowest value of the driving voltage-for-sensing deterioration, which are determined in consideration of the accuracy of sensing of the deterioration of the organic light-emitting diode within the display panel.

The driving voltage sensing circuit may include: a switch allowing the driving voltage-for-sensing deterioration to be applied as an input signal in the deterioration sensing period; a first comparator including an operational amplifier, wherein the driving voltage-for-sensing deterioration is supplied to an inverting input terminal of the first comparator through the switch, and the lowest value of the driving voltage-for-sensing deterioration is supplied to a non-inverting input terminal of the first comparator; a second comparator including an operational amplifier, wherein the driving voltage-for-sensing deterioration is supplied to a non-inverting input terminal of the second comparator, and the highest value of the driving voltage-for-sensing deterioration is supplied to an inverting input terminal of the second comparator; a first low-pass filter connected to an output terminal of the first comparator to transfer a first driving voltage sensing signal from the first comparator to the timing controller; and a second low-pass filter connected to an output terminal of the second comparator to transfer a second driving voltage sensing signal from the second comparator to the timing controller.

The display device may further include: a first register connected to the output terminal of the first low-pass filter; and a second register connected to the output terminal of the second low-pass filter.

The timing controller may control the power management integrated circuit to increase the driving voltage-for-sensing deterioration if the first driving voltage sensing signal is in a high level, and control the power management integrated circuit to decrease the driving voltage-for-sensing deterioration if the second driving voltage sensing signal is in a high level.

According to another aspect of the present disclosure, provided is a driving voltage sensing circuit sensing a driving voltage supplied in a deterioration sensing period in which deterioration of a plurality of organic light-emitting diodes of a display panel is sensed. The driving voltage sensing circuit may include: a switch allowing the driving voltage-for-sensing deterioration to be supplied as an input signal in the deterioration sensing period; a first comparator including an operational amplifier, wherein the driving voltage-for-sensing deterioration is supplied to an inverting input terminal of the first comparator through the switch, and a lowest value of the driving voltage-for-sensing deterioration is supplied to a non-inverting input terminal of the first comparator; a second comparator including an operational amplifier, wherein the driving voltage-for-sensing deterioration is supplied to a non-inverting input terminal of the second comparator, and a highest value of the driving voltage-for-sensing deterioration is supplied to an inverting input terminal of the second comparator; a first low-pass filter connected to an output terminal of the first comparator to transfer a first driving voltage sensing signal from the first comparator to the timing controller; and a second low-pass filter connected to an output terminal of the second comparator to transfer a second driving voltage sensing signal from the second comparator to the timing controller.

According to one or more embodiments, it is possible to effectively compensate for deterioration of an organic light-emitting diode (OLED) disposed in each of subpixels by accurately sensing a change of charged capacitance depending on a current flowing through the organic light-emitting diode in a deterioration sensing period of the organic light-emitting diode.

According to one or more embodiments, it is possible to maintain a driving voltage-for-sensing deterioration, applied to the display panel in the deterioration sensing period of the organic light-emitting diode, within a reference range.

According to one or more embodiments, it is possible to accurately sense the deterioration of the organic light-emitting diode by maintaining the driving voltage-for-sensing deterioration, applied in the deterioration sensing period, within the reference range.

Another aspect of the present disclosure is to provide a display device including: a power management integrated circuit, a driving voltage sensing circuit, and a timing controller.

According to one or more embodiments, the power management integrated circuit is configured to supply a driving voltage-for-sensing deterioration to the driving voltage sensing circuit.

According to one or more embodiments, the driving voltage sensing circuit is configured to: sense whether or not the driving voltage-for-sensing deterioration received is outside of a reference range; and output a driving voltage sensing signal according to a result of the sensing.

According to one or more embodiments, the timing controller is electrically coupled to the driving voltage sensing circuit.

According to one or more embodiments, the driving voltage sensing circuit includes: a first comparator including a first operational amplifier having an output terminal, an inverting input terminal and a non-inverting input terminal; a second comparator including a second operational amplifier having an output terminal, an inverting input terminal and a non-inverting input terminal; a switch capable of selectively providing a sensing driving voltage, wherein one end of the switch is commonly connected to the inverting input terminal of the first comparator and the non-inverting input terminal of the second comparator, wherein the sensing driving voltage ranging between a lowest value and a highest value; a first low-pass filter connected to the output terminal of the first comparator; and a second low-pass filter connected to the output terminal of the second comparator, wherein the lowest value of the sensing driving voltage is supplied to the non-inverting input terminal of the first comparator, and the highest value of the sensing driving voltage is supplied to the inverting input terminal of the second comparator.

According to one or more embodiments, the first comparator is configured to compare the lowest value of the sensing driving voltage and the sensing driving voltage, and the second comparator is configured to compare the highest value of the sensing driving voltage and the sensing driving voltage.

According to one or more embodiments, the switch is configured to operate at image driving period and a deterioration sensing period, wherein the switch is electrically disconnected at the image driving period and electrically connected at the deterioration sensing period to provide the sensing driving voltage.

According to one or more embodiments, the first comparator outputs a logic high-level signal if the sensing driving voltage is less than the lowest value of the sensing driving voltage, and outputs a logic low-level output if the sensing driving voltage is greater than the lowest value of the sensing driving voltage.

According to one or more embodiments, the second comparator outputs a logic high-level signal if the sensing driving voltage is greater than the highest value of the sensing driving voltage, and outputs a logic low-level output if the sensing driving voltage is less than the highest value of the sensing driving voltage.

According to one or more embodiments, the timing controller is configured to: determine whether the sensing driving voltage is less than the lowest value of the sensing driving voltage; and in response to determining the sensing driving voltage is less than the lowest value of the sensing driving voltage, control the sensing driving voltage supplied by the power management integrated circuit to be increased.

According to one or more embodiments, the timing controller is configured to: determine whether the sensing driving voltage is greater than the highest value of the sensing driving voltage; and in response to determining the sensing driving voltage is greater than the highest value of the sensing driving voltage, control the sensing driving voltage supplied by the power management integrated circuit to be decreased.

BRIEF DESCRIPTION OF THE SEVERAL VIEWS OF THE DRAWINGS

The above and other objects, features, and advantages of the present disclosure will be more clearly understood from the following detailed description, taken in conjunction with the accompanying drawings, in which.

DETAILED DESCRIPTION

Figure 1:
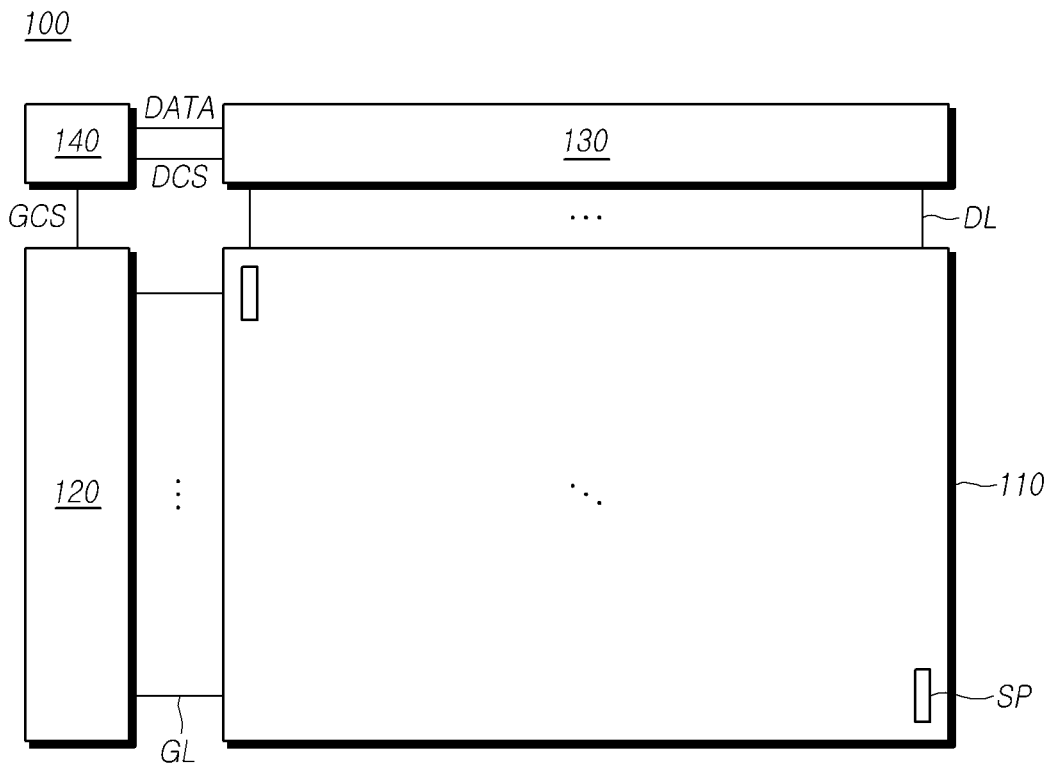
FIG. 1 illustrates a schematic configuration of a display device according to one or more embodiments.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated into the present disclosure will be omitted in the case that the subject matter of the present disclosure may be rendered unclear thereby.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected," "coupled," or "linked" to another element, not only can it be "directly connected, coupled, or linked" to the other element, but it can also be "indirectly connected, coupled, or linked" to the other element via an "intervening" element.

FIG. 1 illustrates a schematic configuration of a display device according to one or more embodiments.

Referring to FIG. 1, the display device 100 according to one or more embodiments may include a display panel 110 in which a plurality of subpixels SP are arrayed in rows and columns, a gate driver circuit 120 and a data driver circuit 130 driving the display panel 110, and a timing controller 140 controlling the gate driver circuit 120 and the data driver circuit 130.

In the display panel 110, a plurality of gate lines GL and a plurality of data lines DL are disposed, and a plurality of subpixels SP are arrayed in adjacent areas in which the plurality of gate lines GL overlap the plurality of data lines DL. For example, in an organic light-emitting display device or organic light-emitting diode (OLED) display device having a resolution of 2,160×3,840, that is, 2,160 gate lines GL and 3,840 data lines DL may be provided, and plurality of subpixels SP may be arrayed in adjacent areas in which the plurality of gate lines GL overlap the plurality of data lines DL.

The gate driver circuit 120 is controlled by the timing controller 140, and controls the driving timing of the plurality of subpixels SP by sequentially outputting a scan signal to the plurality of gate lines GL disposed in the display panel 110. In an OLED display device having a resolution of 2,160×3,840, sequential output of a scan signal to the 2,160 gate lines GL, in particular, from the first gate line GL1 to the 2,160th gate line GL, may be referred to as 2,160-phase driving. In addition, a case in which the scan signal is output sequentially to every four gate lines, as in a case in which the scan signal is output sequentially to four gate lines, such as first to fourth gate lines GL1 to GL4, and then is output sequentially to next four gate lines, such as fifth to eighth gate lines GL5 to GL8, may be referred to as 4-phase driving. As described above, a case in which the scan signal is output sequentially to every N number of gate lines may be referred as N-phase driving.

The gate driver circuit 120 may include one or more gate driver integrated circuits (GDIC), which may be disposed on one side or both sides of the display panel 110 depending on the driving system. Alternatively, the gate driver circuit 120 may be implemented using a gate-in-panel (GIP) structure embedded in a bezel area of the display panel 110.

In addition, the data driver circuit 130 receives image data from the timing controller 140, and converts the received image data into an analog data voltage. Afterwards, the data driver circuit 130 outputs the data voltage Vdata to each of the data lines DL at points in time at which the scan signal is applied through the gate lines GL, so that each of the subpixels SP connected to the data lines DL are lit at a corresponding luminous intensity in response to the data voltage Vdata.

Likewise, the data driver circuit 130 may include one or more source driver ICs (SDICs). Each of the source driver ICs may be connected to a bonding pad of the display panel 110 by a tape-automated bonding (TAB) method or a chip-on-glass (COG) method, or may be directly mounted on the display panel 110. In some cases, each of the source driver ICs may be integrated with the display panel 110. In addition, each of the source driver ICs may be implemented using a chip-on-film (COF) structure. In this case, the source driver ICs may be mounted on circuit films to be electrically connected to the data lines DL in the display panel 110 via the circuit films.

The timing controller 140 supplies a variety of control signals to the gate driver circuit 120 and the data driver circuit 130, and controls the operations of the gate driver circuit 120 and the data driver circuit 130. That is, the timing controller 140 controls the gate driver circuit 120 to output the scan signal at points in time realized by respective frames, and on the other hand, converts data input from an external source into image data having a data signal format readable by the data driver circuit 130 and outputs the converted image data to the data driver circuit 130.

Here, the timing controller 140 receives a variety of timing signals, including a vertical synchronization signal Vsync, a horizontal synchronization signal Hsync, an input data enable (DE) signal, a clock (CLK) signal, and the like, from an external source (e.g., a host system). Accordingly, the timing controller 140 generates a variety of control signals using the variety of timing signals received from the external source, and outputs the variety of control signals to the gate driver circuit 120 and the data driver circuit 130.

For example, the timing controller 140 outputs a variety of gate control signals GCS, including a gate start pulse (GSP) signal, a gate shift clock (GSC) signal, a gate output enable (GOE) signal, and the like, to control the gate driver circuit 120. Here, the gate start pulse signal is used to control the operation start timing of one or more gate driver ICs of the gate driver circuit 120. In addition, the gate shift clock signal is a clock signal commonly input to the one or more gate driver ICs to control the shift timing of the scan signal. The gate output enable signal designates timing information of the one or more gate driver ICs.

In addition, the timing controller 140 outputs a variety of data control signals DCS, including a source start pulse (SSP) signal, a source sampling clock (SSC) signal, a source output enable (SOE) signal, and the like, to control the data driver circuit 130. Here, the source start pulse signal is used to control the data sampling start timing of one or more source driver ICs of the data driver circuit 130. The source sampling clock signal is a clock signal controlling the sampling timing of data in each of the source driver ICs. The source output enable signal controls the output timing of the data driver circuit 130.

The display device 100 may further include a power management IC (PMIC) supplying various forms of voltage or current to the display panel 110, the gate driver circuit 120, the data driver circuit 130, and the like, or controls various forms of voltage or current to be supplied to the same.

The subpixels SP are located adjacent to points at which the gate lines GL overlap the data lines DL, and a light-emitting element may be disposed in each of the subpixels SP. For example, the display device 100 includes a light-emitting element, such as a light-emitting diode (LED) or an organic light-emitting diode (OLED) in each of the subpixels SP, and may display an image by controlling current flowing through the light-emitting elements in response to the data voltage.

Figure 2:
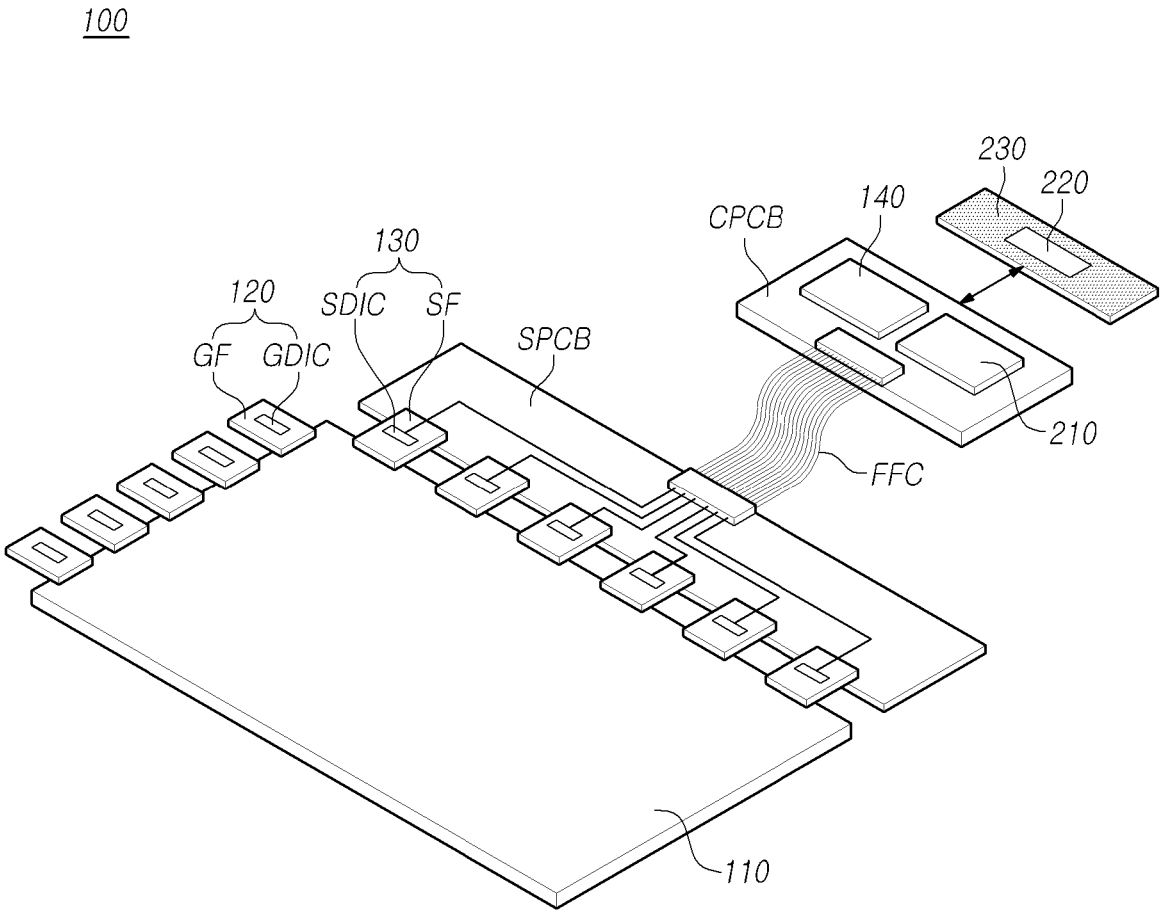
FIG. 2 illustrates a system of the OLED display device according to one or more embodiments.

FIG. 2 illustrates a system of the OLED display device according to one or more embodiments.

In the OLED display device 100 illustrated in FIG. 2, each of the source driver ICs SDIC of the data driver circuit 130 is implemented using a COF structure among a plurality of structures, such as a TAB structure, a COG structure, and a COF structure, and the gate driver circuit 120 is implemented using a GIP structure among a variety of structures, such as a TAB structure, a COG structure, a COF structure, and a GIP structure.

The source driver ICs SDIC of the data driver circuit 130 may be mounted on source-side circuit films SF, respectively. One portion of each of the source-side circuit films SF may be electrically connected to the display panel 110. In addition, lines may be disposed in the top portion of the source-side circuit films SF to electrically connect the source driver ICs SDIC and the display panel 110.

The OLED display device 100 may include at least one source printed circuit board SPCB and a control printed circuit board CPCB, on which control components and a variety of electric devices are mounted, in order to connect the plurality of source driver ICs SDIC to the circuits of the other devices.

The other portion of each of the circuit films SF, on which the source driver ICs SDIC are mounted, may be connected to the at least one source printed circuit board SPCB. That is, one portion of each of the circuit films SF, on which the source driver ICs SDIC are mounted, may be electrically connected to the display panel 110, while the other portion of each of the source-side circuit films SF may be electrically connected to the source printed circuit board SPCB.

The timing controller 140 and a power management IC (PMIC) 210 may be mounted on the control printed circuit board CPCB. The timing controller 140 may control the operations of the data driver circuit 130 and the gate driver circuit 120. The power management IC 210 may control various forms of voltage or current, including a driving voltage, to the data driver circuit 130, the gate driver circuit 120, and the like, or may control the supply of voltage or current to the same.

A circuit connection between the at least one source printed circuit board SPCB and the control printed circuit board CPCB may be provided by at least one connecting member. The connecting member may be, for example, a flexible printed circuit (FPC), a flexible flat cable (FFC), or the like. The at least one source printed circuit board SPCB and the control printed circuit board CPCB may be integrated into a single printed circuit board.

The OLED display device 100 may further include a set board 230 electrically connected to the control printed circuit board CPCB. The set board 230 may also be referred to as a power board. A main power management circuit (M-PMC) 220 performing overall power management of the OLED display device 100 may be present on the set board 230. The main power management circuit 220 may work in concert with the power management IC 210.

In the OLED display device having the above-described configuration, a driving voltage EVDD is generated by the set board 230 to be transferred to the power management IC 210. The power management IC 210 transfers the driving voltage EVDD, necessary during an image driving period or a deterioration sensing period, to the source printed circuit board SPCB through a flexible flat cable FFC, or via a flexible printed circuit (FPC). The driving voltage EVDD, transferred to the source printed circuit board SPCB, is supplied to a specific subpixel SP in the display panel 110 via the source driver ICs SDIC, so that the subpixel SP is lit or performs a sensing operation.

Each of the subpixels SP, arrayed in the display panel 110 of the OLED display device 100, may include a light-emitting element, such as an organic light-emitting diode (OLED), and circuit elements, such as a driving transistor, driving the organic light-emitting diode.

The type and number of circuit elements of each of the subpixels SP may be variously determined, depending on the function provided, the design, or the like.

Figure 3:
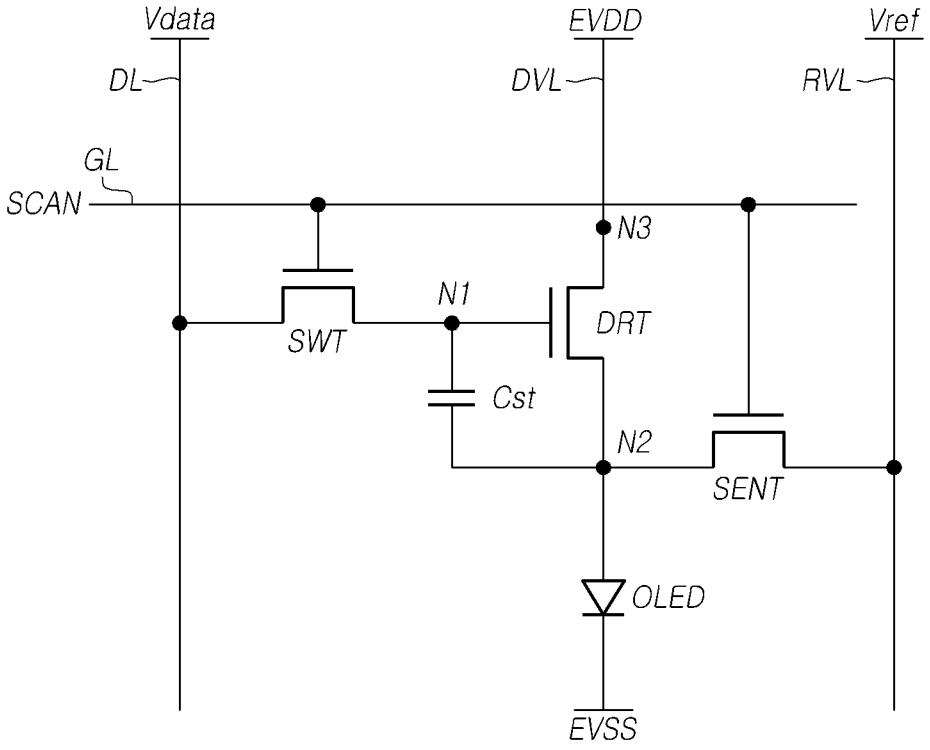
FIG. 3 illustrates a circuit structure of each of the subpixels arrayed in the display device according to one or more embodiments.

FIG. 3 illustrates a circuit structure of each of the subpixels SP arrayed in the display device according to one or more embodiments.

Referring to FIG. 3, each of the subpixels SP arrayed in the display device 100 according to one or more embodiments may include one or more transistors and a capacitor, with an organic light-emitting diode OLED being disposed therein.

For example, the subpixel SP may include a driving transistor DRT, a switching transistor SWT, a sensing transistor SENT, a storage capacitor Cst, and the organic light-emitting diode OLED.

The driving transistor DRT has a first node N1, a second node N2, and a third node N3. The first node N1 of the driving transistor DRT may be a gate node, to which a data voltage Vdata is applied through a data line DL, when the switching transistor SWT is turned on. The second node N2 of the driving transistor DRT may be electrically connected to an anode of the organic light-emitting diode OLED, and may be a drain node or a source node.

Here, in the image driving period, the driving voltage necessary for the image driving period may be supplied to the driving voltage line DVL. For example, the driving voltage EVDD necessary for the image driving may be about 27 V.

The switching transistor SWT is electrically connected between the first node N1 of the driving transistor DRT and the data line DL. The switching transistor SWT operates in response to the scan signal supplied thereto through the gate line GL as the gate line GL is connected to the gate node. In addition, when the switching transistor SWT is turned on, the data voltage Vdata supplied through the data line DL is transferred to the gate node of the driving transistor DRT, thereby controlling the operation of the driving transistor DRT.

The sensing transistor SENT is electrically connected between the second node of the driving transistor DRT and a reference voltage line RVL, and operates in response to the scan signal SCAN supplied thereto through the gate line GL as the gate line GL is connected to the gate node. When the sensing transistor SENT is turned on, a reference voltage Vref supplied through the reference voltage line RVL is transferred to the second node N2 of the driving transistor DRT.

That is, the voltages of the first node N1 and the second node N2 of the driving transistor DRT may be controlled by controlling the switching transistor SWT and the sensing transistor SENT. Consequently, a current for driving the organic light-emitting diode OLED can be supplied.

The switching transistor SWT and the sensing transistor SENT may be connected to a single gate line GL or to different signal lines. Hereinafter, a structure by which the switching transistor SWT and the sensing transistor SENT are connected to a single gate line GL will be described by way of example. In this case, the switching transistor SWT and the sensing transistor SENT can be simultaneously controlled using the single gate line GL, so that the aperture ratio of the subpixels SP can be improved.

In addition, the transistors disposed in the subpixels SP may be not only n-type transistors, but also p-type transistors. Herein, the transistors are described as being n-type transistors by way of example.

The storage capacitor Cst is electrically connected between the first node N1 and the second node N2 of the driving transistor DRT, and serves to maintain the data voltage Vdata for a one-frame period.

Such a storage capacitor Cst may be connected between the first node N1 and the third node N3 of the driving transistor DRT, depending on the type of the driving transistor DRT. The anode of the organic light-emitting diode OLED may be electrically connected to the second node N2 of the driving transistor DRT, and a base voltage EVSS may be applied to a cathode of the organic light-emitting diode OLED. Here, the base voltage EVSS may be the ground voltage or a voltage higher or lower than the ground voltage. In addition, the base voltage EVSS may vary depending on the driving condition. For example, the base voltage EVSS in the image driving period may be set differently from the base voltage EVSS in the deterioration sensing period.

Figure 4:
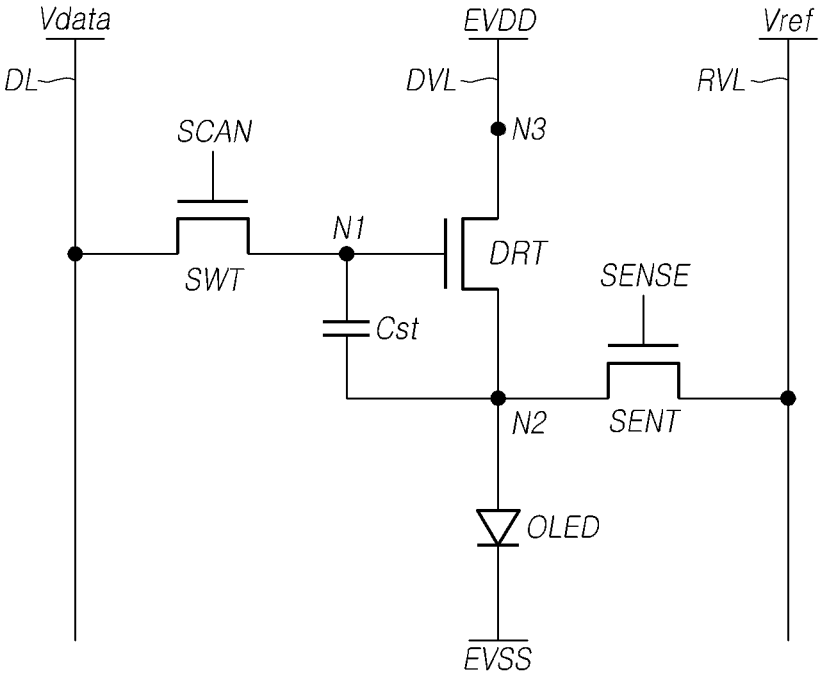
FIG. 4 illustrates another circuit structure of each of the subpixels arrayed in the display device according to one or more embodiments, in which the switching transistor and the sensing transistor are connected to different signal lines, respectively.

FIG. 4 illustrates another circuit structure of each of the subpixels SP arrayed in the display device according to one or more embodiments, in which the switching transistor SWT and the sensing transistor SET are connected to different signal lines, respectively.

Referring to FIG. 4, the switching transistor SWT may be on-off controlled by a scan signal SCAN applied to a gate node thereof through a corresponding gate line, while the sensing transistor SENT may be on-off controlled by a sense signal SENSE, different from the scan signals SCAN, applied to a gate node thereof through a corresponding gate line.

In a case in which the switching transistor SWT and the sensing transistor SENT are controlled by different signals, e.g., the scan signal SCAN and the sense signal SENSE, the switching transistor SWT and the sensing transistor SENT may be controlled independently of each other, but the aperture ratio of the subpixel SP may be lowered.

Each of the subpixels SP, illustrated in FIGS. 3 and 4, has a 3T1C structure comprised of three transistors and one capacitor. However, this is merely for illustrative purposes, and one or more transistors, or in some cases, one or more capacitors may be further included. In addition, the plurality of subpixels SP may have the same structure, or some of the plurality of subpixels SP may have a different structure from the remaining subpixels.

The organic light-emitting diode OLED emits light using a current supplied in response to the operation of the driving transistor DRT, so that the corresponding subpixel SP expresses a luminous intensity corresponding to the data voltage Vdata.

Here, the organic light-emitting diode OLED may deteriorate over time. In a case in which the organic light-emitting diode OLED has deteriorated, the organic light-emitting diode OLED may not be able to express a luminous intensity corresponding to the data voltage Vdata supplied to the subpixel SP. In addition, the organic light-emitting diodes OLED, included in respective subpixels SP, may have deteriorated to different degrees, which may cause different luminous intensities. This may further negatively impact user experience by failing to provide consistent luminosity during the use of the display device.

Accordingly, the display device 100 according to one or more embodiments enables to sense deterioration of the subpixels SP and compensate for the deterioration. To sense the deterioration of the subpixels SP, a sensing data voltage Vdata is supplied to the subpixels SP in a section in which the deterioration of the organic light-emitting diodes OLED can be sensed, so that currents can flow through the organic light-emitting diodes OLED, and changes in the amount of capacitance charged in parasitic capacitors Coled (see FIGS. 7 to 9) of the organic light-emitting diodes OLED are detected. In this manner, any deterioration of the organic light-emitting diodes OLED can be measured. For example, the deterioration or the degradation of an OLED may be determined based on the changes in the amount of parasitic capacitance charged in the parasitic capacitor of the OLED.

Here, in order to efficiently sense the deterioration of the organic light-emitting diode OLED, a method of measuring a current induced by a voltage charged in a parasitic capacitor Coled by supplying a driving voltage, lower than a driving voltage supplied during the image driving period, during a deterioration sensing period of the organic light-emitting diode OLED, is used. This method is also referred to as current sensing.

Figure 5:
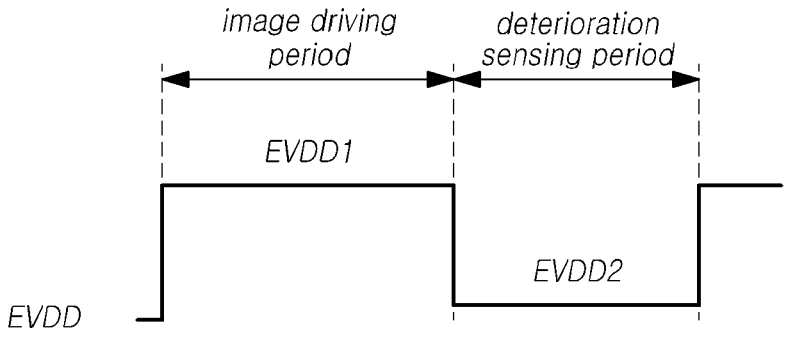
FIG. 5 illustrates a driving voltage applied to the display panel in an image driving period and a deterioration sensing period, in the display device according to one or more embodiments.

FIG. 5 illustrates a driving voltage applied to the display panel in an image driving period and a deterioration sensing period, in the display device according to one or more embodiments.

Referring to FIG. 5, an image driving voltage EVDD1, applied to the display panel 110 in the image driving period, and a driving voltage-for-sensing deterioration EVDD2, applied to the display panel 110 in the deterioration sensing period for sensing the organic light-emitting diode OLED, have different values. Since the driving voltage-for-sensing deterioration EVDD2 is applied at a lower level than the image-driving voltage EVDD1, the degree of deterioration of the organic light-emitting diode OLED can be accurately sensed.

The image-driving voltage EVDD1 and driving voltage-for-sensing deterioration EVDD2 may vary depending on the configuration, model, or the like, of the OLED display device 100. For example, the image-driving voltage EVDD1 may be about 27V, while the driving voltage-for-sensing deterioration EVDD2 may be about 10V.

Figure 6:
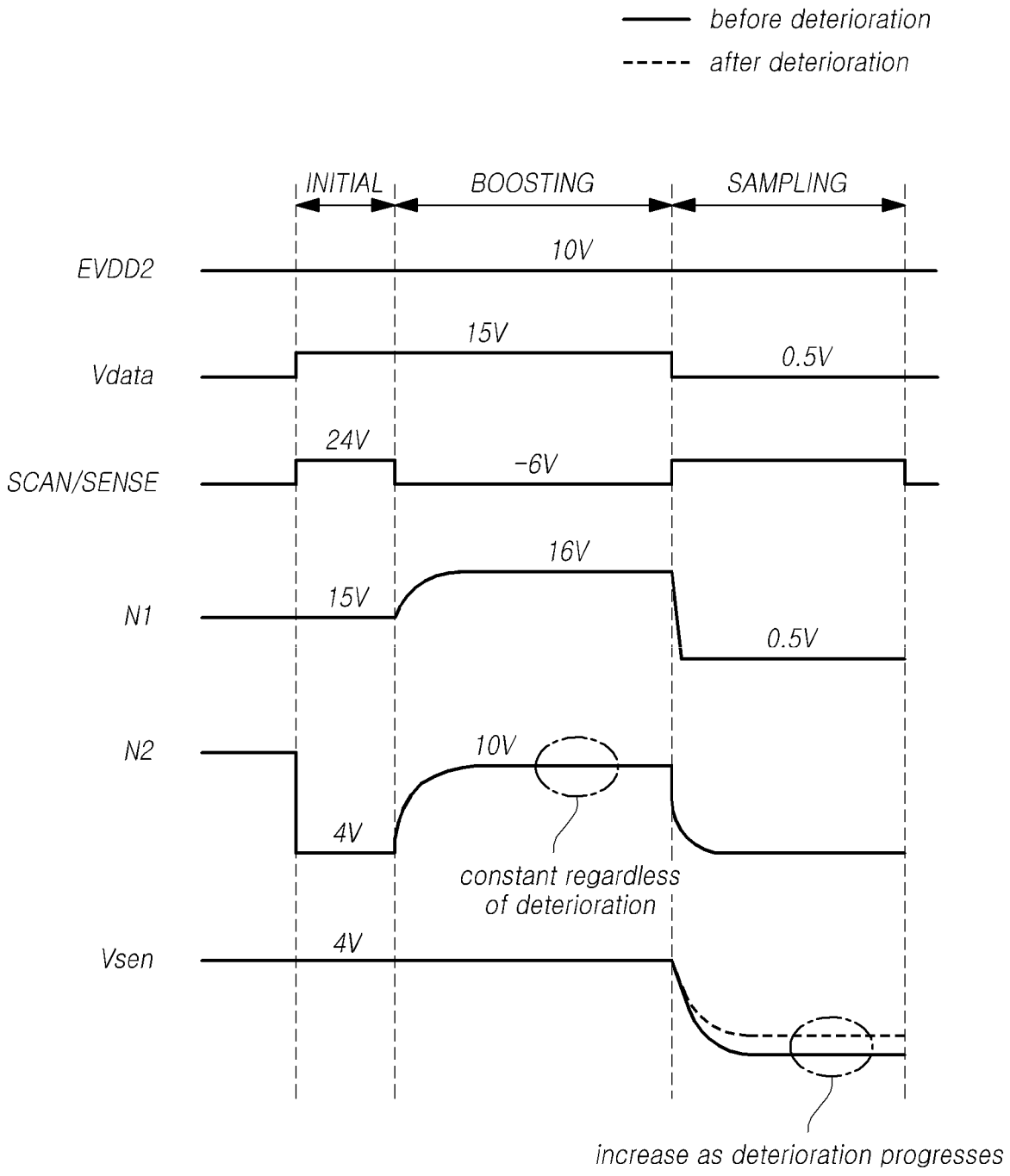
FIG. 6 illustrates a signal timing diagram in the display device according to one or more embodiments, in which deterioration of the subpixel is sensed using a driving voltage-for-sensing deterioration.

FIG. 6 illustrates a signal timing diagram in the display device according to one or more embodiments, in which deterioration of the subpixel SP is sensed using the driving voltage-for-sensing deterioration EVDD2.

Referring to FIG. 6, the deterioration-sensing period of the organic light-emitting diode OLED may include an initializing period INITIAL, a boosting period BOOSTING, a sampling period SAMPLING, and a recovery period.

The initializing period INITIAL is a section in which a voltage for sensing the deterioration of the organic light-emitting diode OLED is charged. In the initializing period INITIAL, a logic high-level scan signal (e.g., about 24V) may be applied to the gate lines GL.

The boosting period BOOSTING is a section in which a current is caused to flow through the organic light-emitting diode OLED after the charging of the voltage for sensing deterioration of the organic light-emitting diode OLED is completed, so that the parasitic capacitor Coled of the organic light-emitting diode OLED is charged with capacitance.

The sampling period SAMPLING is a section in which, after the parasitic capacitor Coled is charged, an amount of capacitance charged in the parasitic capacitor Coled is detected.

The recovery period is a predetermined section from after the completion of the deterioration sensing of the organic light-emitting diode OLED and before restart of the display driving. The recovery period may be regarded as a section in which a voltage applied to each of the voltage lines is reset for the display driving after the deterioration sensing of the organic light-emitting diode OLED.

Figure 7:
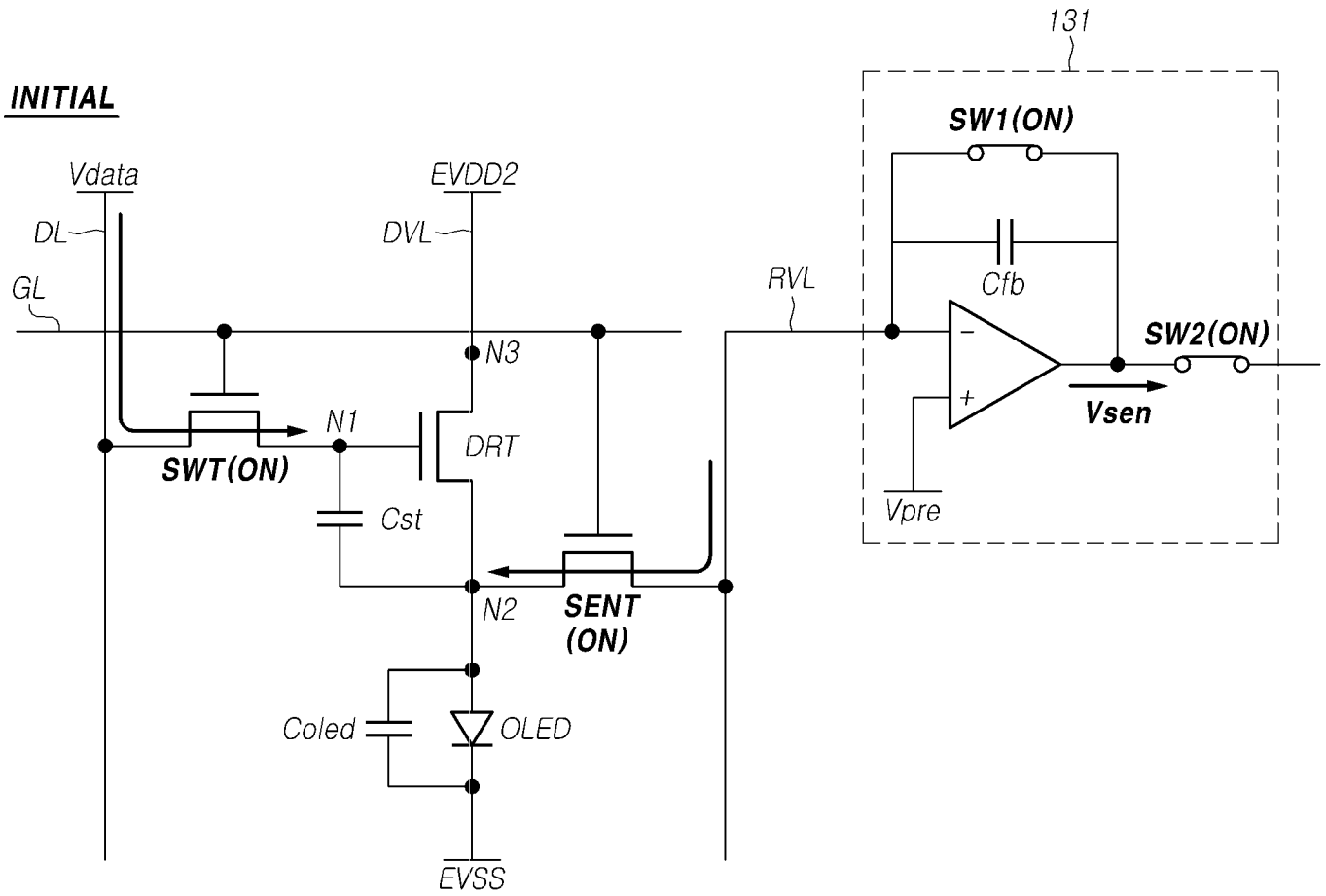
FIGS. 7 to 9 illustrate operating states of the subpixel in the initializing period, the boosting period, and the sampling period, in the process of sensing deterioration of the organic light-emitting diode.
Figure 8:
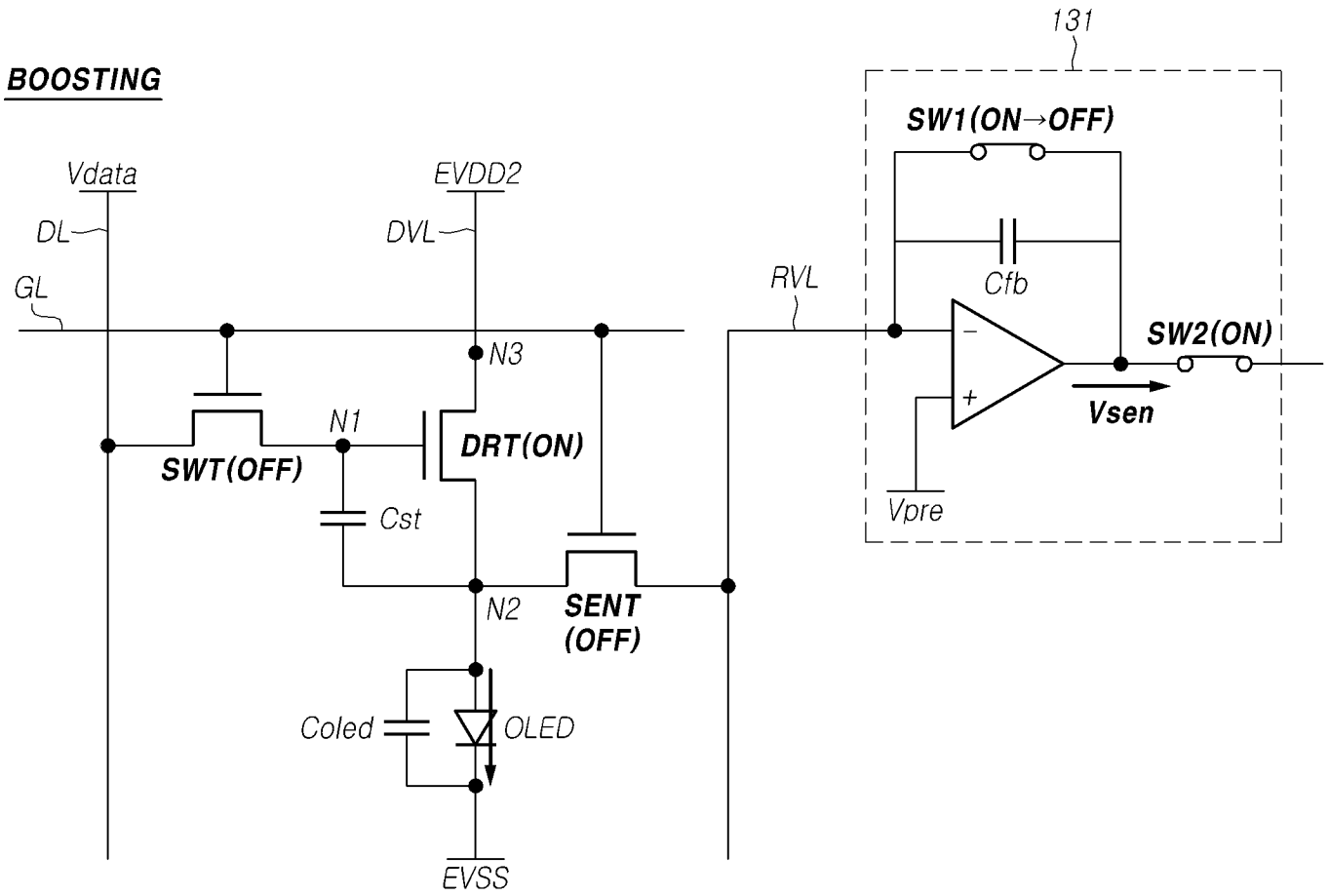
Figure 9:
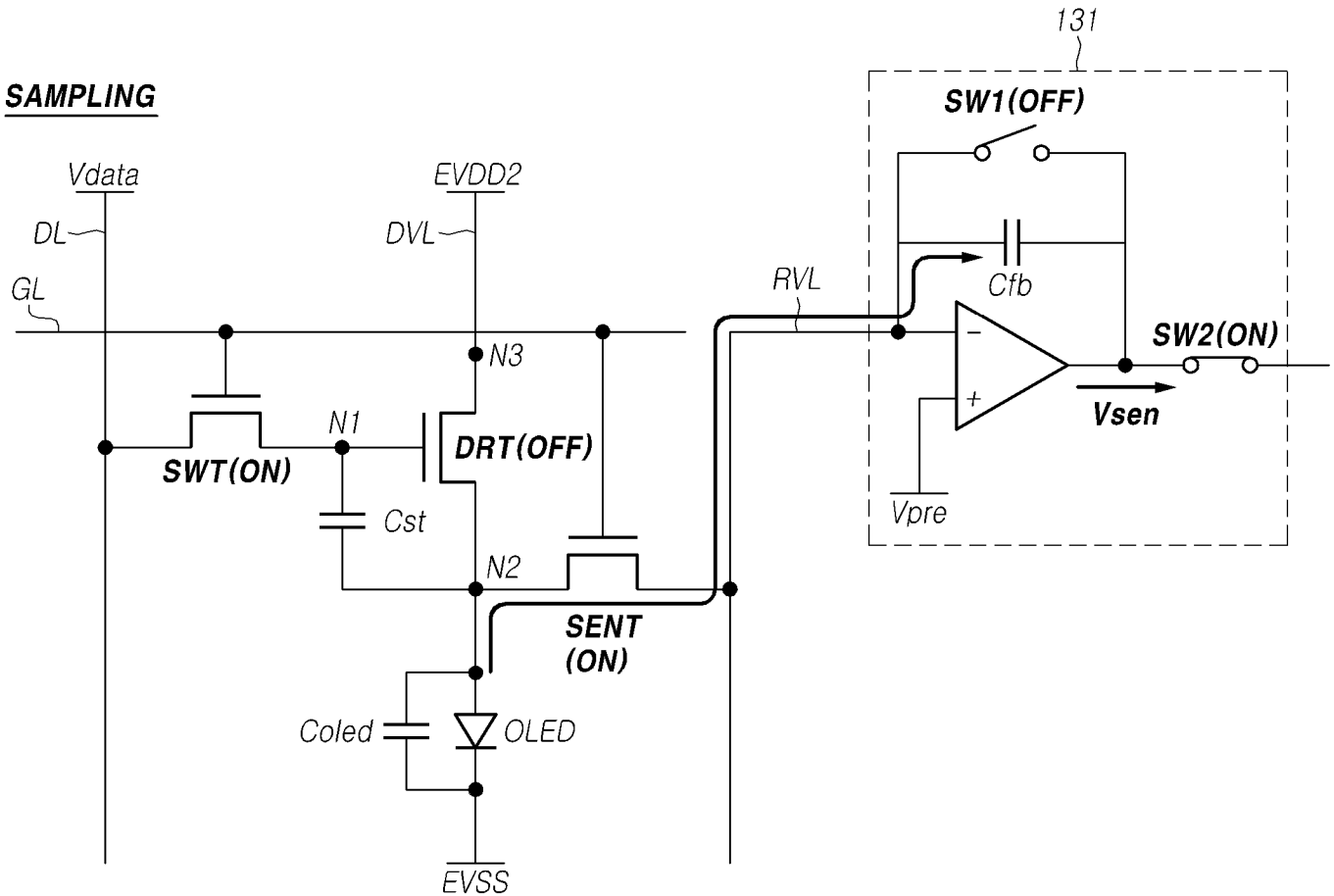

FIGS. 7 to 9 illustrate operating states of the subpixel in the initializing period INITIAL, the boosting period BOOSTING, and the sampling period SAMPLING, in the process of sensing deterioration of the organic light-emitting diode OLED. Hereinafter, the process of sensing the deterioration of the organic light-emitting diode OLED will be described in more detail with reference to FIGS. 6 to 9.

The deterioration sensing of the organic light-emitting diode OLED may be performed in a period distinguishable from the image driving period. For example, the deterioration sensing may be performed before the image driving is performed in response to the display device 100 being turned on or after the display device 100 is turned off. Alternatively, the deterioration sensing may be performed in a horizontal blank period or a vertical blank period, or may be performed by user input.

Here, the deterioration sensing of the organic light-emitting diode OLED may be performed by a deterioration sensing circuit 131 of the data driver circuit 130. Specifically, the data driver circuit 130 supplies a deterioration-sensing data voltage Vdata through a corresponding data line DL in the deterioration sensing period of the organic light-emitting diode OLED, and allows a deterioration-sensing reference voltage Vpre to be supplied through a reference voltage line RVL. Consequently, a voltage difference is generated between the first node N1 and the second node of the driving transistor DRT, so that a current can be supplied to the organic light-emitting diode OLED, and the parasitic capacitor Coled of the organic light-emitting diode OLED can be charged with capacitance.

Here, the driving voltage-for-sensing deterioration EVDD2, applied through the driving voltage line DVL during the deterioration sensing period of the organic light-emitting diode OLED, may have a lower value (e.g., about 10V) than the image-driving voltage EVDD1, supplied during the image driving period. Thus, the voltage of the anode of the organic light-emitting diode OLED may remain constant, regardless of the deterioration of the organic light-emitting diode OLED. That is, in a state in which the voltage of the anode of the organic light-emitting diode OLED is fixed, changes in the amount of electric charge depending on the current flowing through the organic light-emitting diode OLED may be measured, so that the degree of deterioration of the organic light-emitting diode OLED can be accurately sensed.

The deterioration sensing circuit 131 senses an amount of capacitance charged in the parasitic capacitor Coled of the organic light-emitting diode OLED, and outputs a sensing voltage Vsen depending on the amount of electric charge sensed therein. The output sensing voltage Vsen may be transferred to the timing controller 140. The timing controller 140 determines the degree of deterioration of the organic light-emitting diode OLED, on the basis of the sensing voltage Vsen. In addition, the data voltage Vdata that has been compensated for the deterioration may be supplied to the corresponding subpixel SP, so that the subpixel SP can express an intensity level corresponding to the data voltage Vdata. Accordingly, non-uniform luminous intensities, which would otherwise be caused by different degrees of deterioration, can be prevented.

The deterioration sensing circuit 131 may have a variety of structures. For example, the deterioration sensing circuit 131 may include a feedback capacitor Cfb and an operational (OP) amplifier. The deterioration sensing circuit 131 may further include an initialization switch SW1 for initializing the feedback capacitor Cfb and a sampling switch SW2 for sampling the sensing voltage Vsen.

The OP amplifier may have an input terminal (+), to which the sensing reference voltage Vpre is applied, and an inverting input terminal (−), to which the reference voltage line RVL is connected. In addition, the feedback capacitor Cfb may be electrically connected between the inverting input terminal (−) and an output terminal of the OP amplifier. Thus, since capacitance charged in the parasitic capacitor Coled of the organic light-emitting diode OLED is charged to the feedback capacitor Cfb, changes in the amount of capacitance charged in the parasitic capacitor Coled of the organic light-emitting diode OLED, due to the deterioration of the organic light-emitting diode OLED, can be sensed.

Here, if a greater amount of capacitance is charged in the feedback capacitor Cfb, a value, output by the OP amplifier, is more in the (−) direction. Thus, when the amount of capacitance charged in the parasitic capacitor Coled of the organic light-emitting diode OLED is reduced due to the deterioration of the organic light-emitting diode OLED, the sensing voltage Vsen may be increased.

During the initializing period INITIAL, a high-level scan signal SCAN is applied to the gate line GL, and the initialization switch SW1 and the sampling switch SW2 of the deterioration sensing circuit 131 remain in a turned-on state.

Consequently, the switching transistor SWT and the sensing transistor SENT are turned on. As the switching transistor SWT is turned on, the deterioration-sensing data voltage Vdata is applied to the first node N1 of the driving transistor DRT. The deterioration-sensing data voltage Vdata may be, for example, 15V. In addition, as the sensing transistor SENT is turned on, the deterioration-sensing reference voltage Vpre is applied to the second node N2 of the driving transistor DRT. The deterioration-sensing reference voltage Vpre may be, for example, about 4V.

Here, the level (e.g., about 10V) of the driving voltage-for-sensing deterioration EVDD2, supplied to the driving voltage line DVL, may be lower than the level (e.g., about 27V) of an image driving voltage EVDD1 supplied during the image driving period. The level of the driving voltage-for-sensing deterioration EVDD2, supplied during the deterioration sensing period of the organic light-emitting diode OLED, is set to be lower than that of the image-driving voltage EVDD1, supplied in the image driving period, in order to ensure the voltage level of the anode of the organic light-emitting diode OLED, e.g., the second node N2 of the driving transistor DRT, is constant. In this manner, the amount of capacitance charged in the parasitic capacitor Coled of the organic light-emitting diode OLED can be accurately sensed.

In this case, the initialization switch SW1 of the deterioration sensing circuit 131 may be maintained in the turned-on state to initialize the feedback capacitor Cfb.

During the boosting period BOOSTING, a low-level scan signal SCAN is applied to the gate line GL. In addition, the initialization switch SW1 and the sampling switch SW2 of the deterioration sensing circuit 131 remain in the turned-on state, and the initialization switch SW1 may be turned off before the start of the sampling period SAMPLING.

As the low-level scan signal SCAN is applied to the gate line GL during the boosting period BOOSTING, the switching transistor SWT and the sensing transistor SENT are turned off. Consequently, the first node N1 and the second node N2 of the driving transistor DRT are floated, so that the voltages of the first node N1 and the second node N2 are gradually increased. As a result, a current flows through the organic light-emitting diode OLED, and thus, the parasitic capacitor Coled of the organic light-emitting diode OLED is charged with capacitance.

In this case, since the level of the driving voltage-for-sensing deterioration EVDD2, applied in the boosting period BOOSTING, is lower than the level of the image-driving voltage EVDD1, the operating voltage of the organic light-emitting diode OLED, e.g., the voltage of the second node N2 of the driving transistor DRT, maintains a constant level, regardless of the deterioration of the organic light-emitting diode OLED. Consequently, the parasitic capacitor Coled of the organic light-emitting diode OLED can be charged with capacitance while the voltage of the anode of the organic light-emitting diode OLED is remaining constant.

Since the amount of capacitance charged in the parasitic capacitor Coled may be reduced with deteriorations in the organic light-emitting diode OLED, the deterioration of the organic light-emitting diode OLED can be sensed by detecting changes of capacitance charged in the parasitic capacitor Coled.

During the sampling period SAMPLING, the high-level scan signal SCAN is applied to the gate line GL, so that the switching transistor SWT and the sensing transistor SENT are turned on. In addition, a data voltage Vdata having a level, by which the driving transistor DRT can be turned off, is supplied to the data line DL. For example, a voltage about 0.5V may be applied to the data line DL. Here, the initialization switch SW1 of the deterioration sensing circuit 131 remains in the turned-off state, and the sampling switch SW2 remains in the turned-on state.

Since the driving transistor DRT is in the turned-off state and the initialization switch SW1 of the deterioration sensing circuit 131 is in the turned-off state, the feedback capacitor Cfb of the deterioration sensing circuit 131 is charged by the capacitance charged in the parasitic capacitor Coled of the organic light-emitting diode OLED.

The OP amplifier of the deterioration sensing circuit 131 outputs the sensing voltage Vsen, depending on the amount of capacitance charged in the feedback capacitor Cfb. If a greater amount of capacitance is charged in the feedback capacitor Cfb, the output value is more in the (−) direction. Thus, if the amount of capacitance charged in the parasitic capacitor Coled is reduced due to the deterioration of the organic light-emitting diode OLED, the amount of capacitance charged in the feedback capacitor Cfb is reduced. Consequently, the OP amplifier outputs the sensing voltage Vsen, increased from the sensing voltage before the deterioration. It is possible to sense the deterioration of the organic light-emitting diode OLED using the value of the sensing voltage Vsen output in this manner.

When the deterioration sensing period is completed, for the display driving after the deterioration sensing, the recovery period of resetting the voltage applied to the respective voltage line may be performed.

However, as the display device 100 has been used for a longer period of time, the subpixels SP experience deterioration. Thus, the probability in that an error may occur in the sensing voltage Vsen of the organic light-emitting diode OLED is increased.

Figure 10:
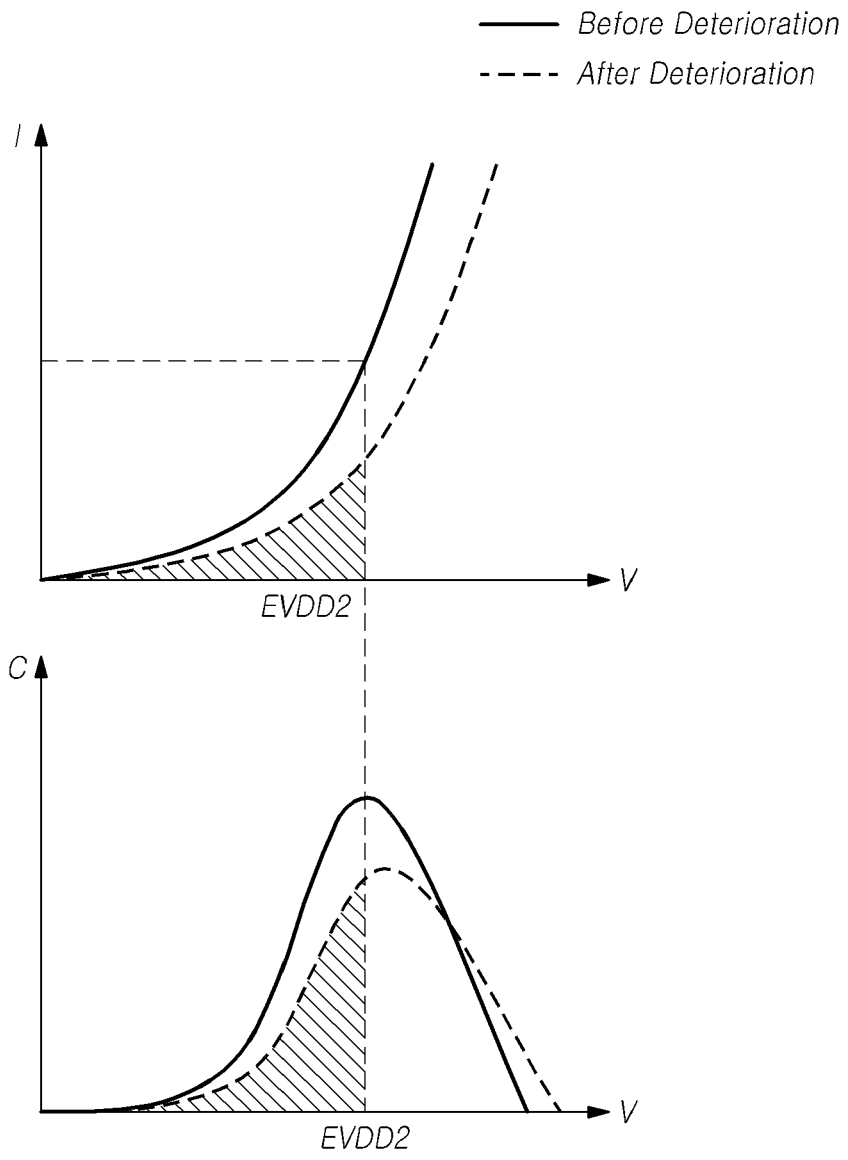
FIG. 10 illustrates changes in the amount of current flowing through and the amount of capacitance charged in the organic light-emitting diode before and after deterioration.

FIG. 10 illustrates changes in the amount of current flowing through and the amount of capacitance charged in the organic light-emitting diode OLED before and after deterioration.

Referring to FIG. 10, with deteriorations in the organic light-emitting diode OLED, a flow of current generated by the voltage applied to the organic light-emitting diode OLED may be reduced. In addition, as the current is reduced, the amount of capacitance charged in the parasitic capacitor Coled of the organic light-emitting diode OLED may be reduced.

Here, when the deterioration of the organic light-emitting diode OLED is sensed in a state in which the driving voltage-for-sensing deterioration EVDD2 is supplied to the driving voltage line DVL in the deterioration sensing period of the organic light-emitting diode OLED, a current may be caused to flow through the organic light-emitting diode OLED in a state in which the operating voltage of the organic light-emitting diode OLED is relatively stable.

However, the precision of the deterioration sensing of the organic light-emitting diode OLED cannot be obtained unless the driving voltage-for-sensing deterioration EVDD2 maintains an accurate value. In a case in which the driving voltage-for-sensing deterioration EVDD2, supplied in the deterioration sensing period of the organic light-emitting diode OLED, is changed without maintaining a constant value, for any reason, such as the instability of the power management IC 210 supplying the driving voltage, variations in power applied to the power management IC 210, or deviations in the circuit elements of the power management IC 210, the amount of current flowing through the organic light-emitting diode OLED and the amount of capacitance charged in the parasitic capacitor Coled in the deterioration sensing period of the organic light-emitting diode OLED may be changed. Consequently, the sensing voltage Vsen regarding the deterioration of the organic light-emitting diode OLED may have an error, thereby making it difficult to accurately compensate for the deterioration of the subpixel SP.

Figure 11:
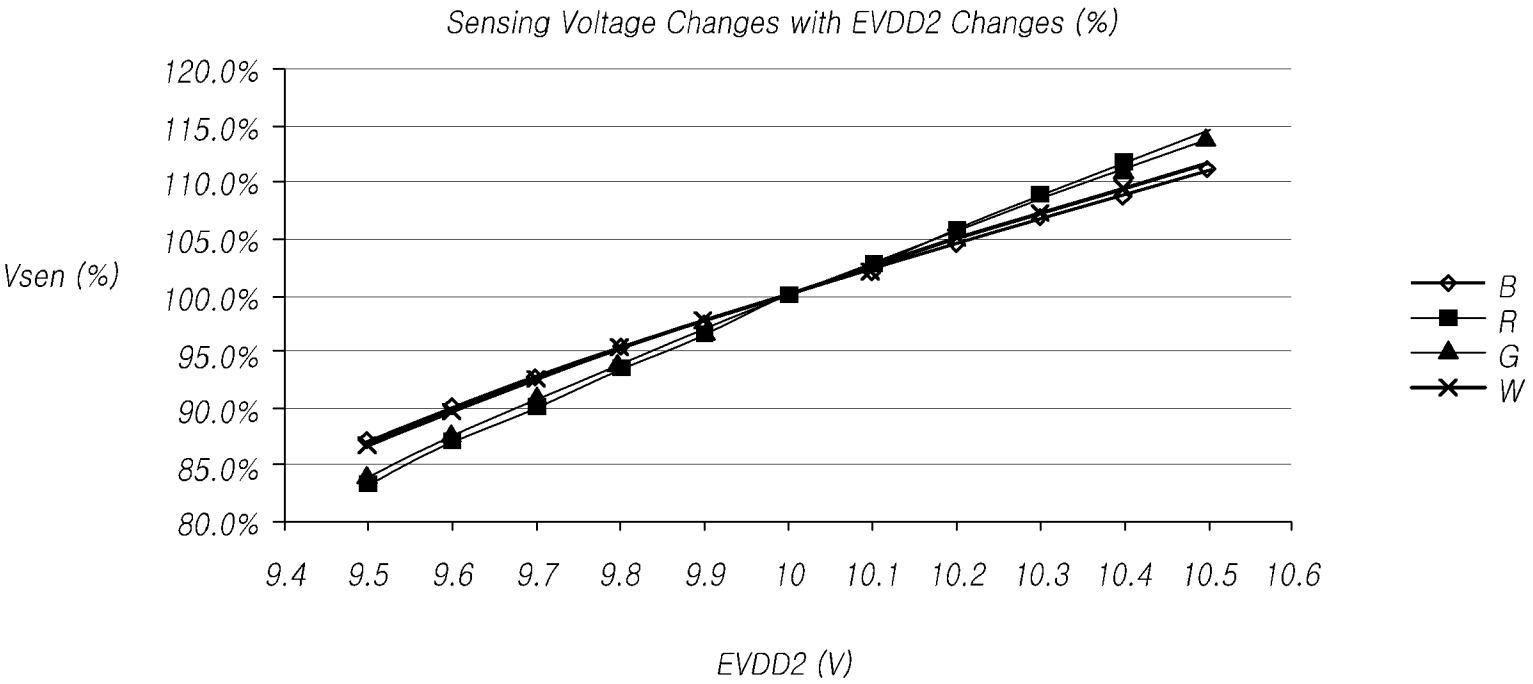
FIG. 11 illustrates a result of experimental measurement of the ratio of changes in the sensing voltage with respect to changes in the driving voltage-for-sensing deterioration, applied in the deterioration sensing period of the organic light-emitting diode.

FIG. 11 illustrates a result of experimental measurement of the ratio of changes in the sensing voltage Vsen with respect to changes in the driving voltage-for-sensing deterioration EVDD2, applied in the deterioration sensing period of the organic light-emitting diode OLED.

Referring to FIG. 11, changes in the sensing voltage Vsen, measured by the deterioration sensing circuit 131, are illustrated with respect to cases in which the driving voltage-for-sensing deterioration EVDD2 was increased and reduced by 0.1V from 10V during the deterioration sensing period of the organic light-emitting diode OLED. Here, the measurements of the sensing voltage Vsen, with respect to the driving voltage-for-sensing deterioration EVDD2, may be mean values of results obtained from a plurality of experiments conducted in the same conditions, although the measurements may be data of a single experiment.

Considering the above experimental result, in a case in which the driving voltage-for-sensing deterioration EVDD2 was changed from about 10V by about 0.2V, it can be appreciated that the sensing voltage Vsen was changed by a ratio of about 5%. This ratio of variation of the sensing voltage Vsen may increase proportionally with increases in the increment of the driving voltage-for-sensing deterioration EVDD2.

Accordingly, even in the case that the driving voltage-for-sensing deterioration EVDD2 is changed due to a plurality of reasons, one or more embodiments can maintain the increment within a specific range, thereby preventing non-uniform luminous intensities caused by deviations in the deterioration sensing of the organic light-emitting diodes OLED. Accordingly, each of the organic light-emitting diodes OLED can express the luminous intensity corresponding to the data voltage Vdata.

In this regard, the display device 100 may further include a driving voltage sensing circuit able to sense the driving voltage-for-sensing deterioration EVDD2 during a period in which the deterioration of the organic light-emitting diode OLED is sensed. In a case in which the driving voltage-for-sensing deterioration EVDD2 is outside of a predetermined range, the timing controller 140 may control the driving voltage-for-sensing deterioration EVDD2 to be adjusted within a normal range.

Figure 12:
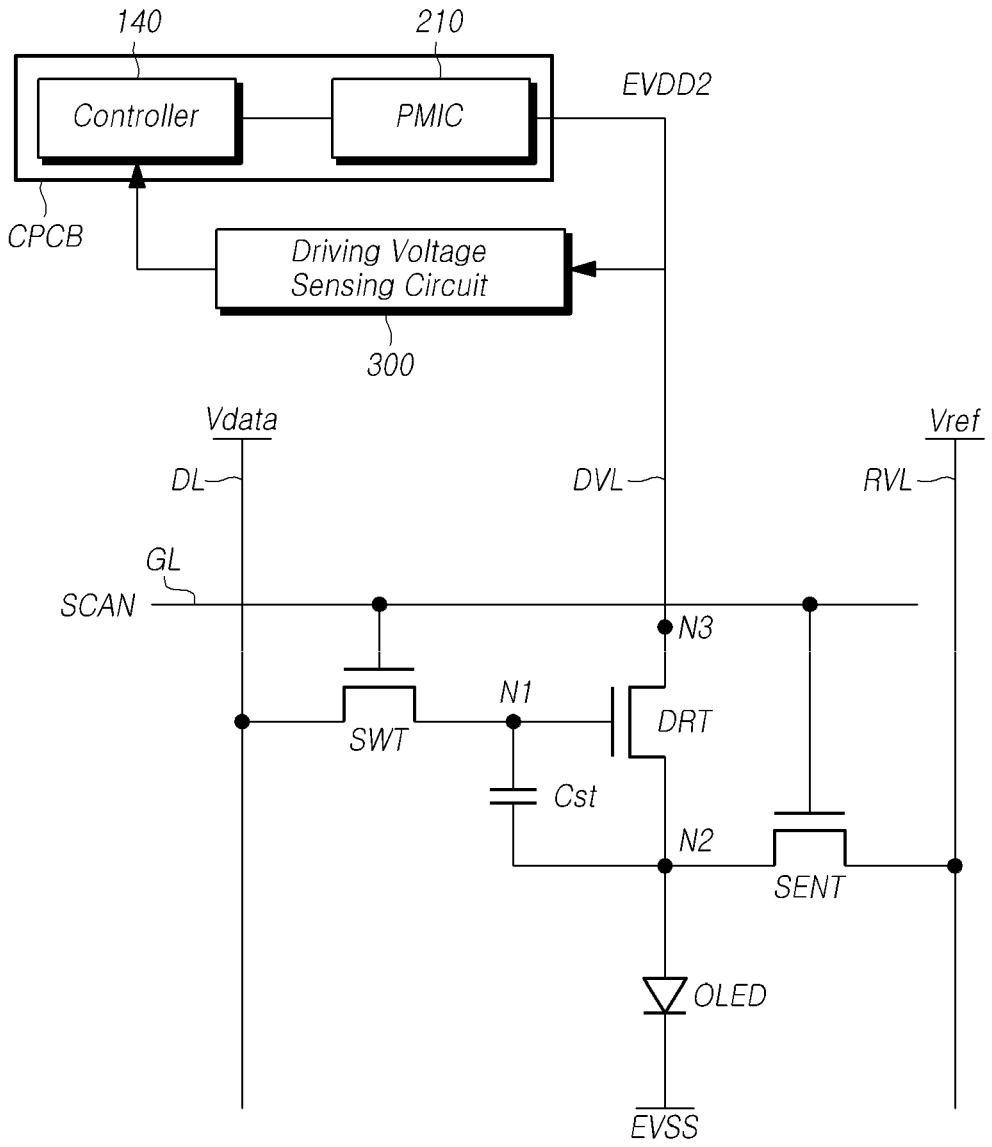
FIG. 12 is a block diagram illustrating the display device according to one or more embodiments.

FIG. 12 is a block diagram illustrating the display device according to one or more embodiments.

Referring to FIG. 12, the display device 100 according to one or more embodiments may further include a driving voltage sensing circuit 300 having an input terminal connected to the driving voltage line DVL and an output terminal connected to the timing controller 140 to sense the driving voltage-for-sensing deterioration EVDD2, supplied to the deterioration sensing period of the organic light-emitting diode OLED, in the driving voltages EVDD applied to the subpixels SP. Here, according to an embodiment, the driving voltage sensing circuit 300 may be disposed on a control printed circuit board CPBC, in the form of a module.

Since the driving voltage sensing circuit 300 is intended to sense the driving voltage-for-sensing deterioration EVDD2, the driving voltage sensing circuit 300 may operate only in a period in which the driving voltage-for-sensing deterioration EVDD2 is applied to the display panel 110 to sense the deterioration of the organic light-emitting diode OLED, for example, in the initializing period INITIAL, the boosting period BOOSTING, the sampling period SAMPLING, and the recovery period. In particular, in a period in which the display device displays an image, the level of the supplied image-driving voltage EVDD1 may be, for example, about 27V, and the level of the driving voltage-for-sensing deterioration EVDD2 may be, for example, about 10V. Accordingly, in the image driving period, the driving voltage-for-sensing deterioration EVDD2 may not be sensed.

If the driving voltage-for-sensing deterioration EVDD2 is outside of a predetermined reference range, the driving voltage sensing circuit 300 may transfer a signal indicative thereof to the timing controller 140, which in turn may control the power management IC 210 to increase or decrease the driving voltage-for-sensing deterioration EVDD2 to be within the reference range. Consequently, the driving voltage-for-sensing deterioration EVDD2 can be adjusted to be within the reference range. Here, the power management IC 210 is a component included in the display device 100 to supply the driving voltages EVDD, including the image-driving voltage EVDD1 and the driving voltage-for-sensing deterioration EVDD2, to the display panel 110. The power management IC 210 may be referred differently, depending on the manufacturers of the display panel 110, and may be regarded as a driving voltage source supplying the driving voltages EVDD to the display device 100.

In addition, in a case in which the driving voltage-for-sensing deterioration EVDD2 is outside of the reference range, the driving voltage sensing circuit 300 may measure a degree, by which the driving voltage-for-sensing deterioration EVDD2 is outside of the reference range, and transfer the measured degree to the timing controller 140, so that the timing controller 140 can determine a range in which the driving voltage-for-sensing deterioration EVDD2 is controlled. This may be different depending on which of simplifying the driving voltage sensing circuit 300 or minimizing the additional operations of the timing controller 140 is efficient.

Herein, by way of example, a case in which the driving voltage sensing circuit 300 determines whether or not the driving voltage-for-sensing deterioration EVDD2 is outside of an reference range, and if the driving voltage-for-sensing deterioration EVDD2 is determined to be outside of an reference range, transfers a result of the determination to the timing controller 140, which in turn controls the driving voltage-for-sensing deterioration EVDD2 to be within the reference range, will be described.

In addition, although a case, in which the switching transistor SWT and the sensing transistor SENT are connected to a single gate line GL to be simultaneously turned on or off by the scan signal SCAN transferred through the single gate line GL, is illustrated herein, the same may be applied to a separated structure in which the scan signal SCAN is applied to the gate node of the switching transistor SWT and the sense signal SENSE is applied to the gate node of the sensing transistor SENT.

Figure 13:
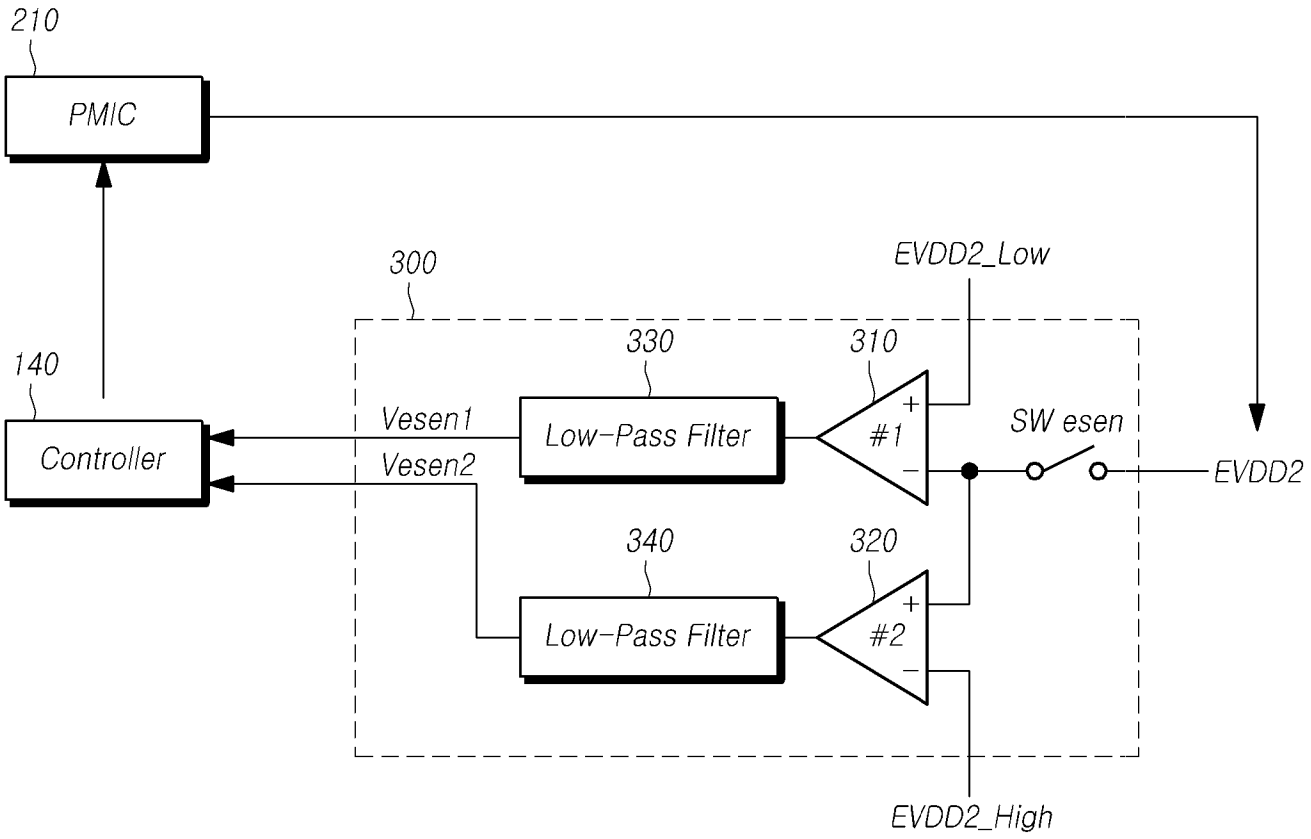
FIG. 13 is a circuit diagram illustrating the driving voltage sensing circuit in the display device according to one or more embodiments.

FIG. 13 is a circuit diagram illustrating the driving voltage sensing circuit in the display device according to one or more embodiments.

Referring to FIG. 13, the driving voltage sensing circuit 300 according to one or more embodiments may include a deterioration sensing switch SW esen, a first comparator 310 comparing an input signal Vin with a lowest value of the driving voltage-for-sensing deterioration EVDD2 Low, a second comparator 320 comparing the input signal Vin with a highest value of the driving voltage-for-sensing deterioration EVDD2 High, a first low-pass filter 330 connected to an output terminal of the first comparator 310, and a second low-pass filter 340 connected to an output terminal of the second comparator 320.

The deterioration-sensing switch SW esen is a switch to which the driving voltage-for-sensing deterioration EVDD2, supplied in the deterioration sensing period in which the deterioration of the organic light-emitting diode OLED is sensed, is applied as an input signal Vin. Thus, the deterioration-sensing switch SW esen may be only turned on in the deterioration sensing period, in which the deterioration of the organic light-emitting diode OLED is sensed, while remaining in the turned-off state in the image driving period.

Here, the driving voltage-for-sensing deterioration EVDD2, applied through the deterioration-sensing switch SW esen, may be connected to the output terminal of the power management IC 210 generating the driving voltages EVDD, or may be connected to the source printed circuit board SPCB, to which the driving voltages EVDD are transferred from the power management IC 210 via a flexible printed circuit (FPC) or a flexible flat cable (FFC). In a case in which the deterioration-sensing switch SW esen is connected to the output terminal of the power management IC 210, deviations between the components within the power management IC 210 may be a major reason of changes in the driving voltage-for-sensing deterioration EVDD2. In a case in which the deterioration-sensing switch SW esen is connected to the source printed circuit board SPCB, a major reason of changes in the driving voltage-for-sensing deterioration EVDD2 may be an error caused by a signal line during the process in which the driving voltage-for-sensing deterioration EVDD2 is being transferred via the flexible printed circuit or the flexible flat cable.

The first comparator 310 receives the driving voltage-for-sensing deterioration EVDD2 as the input signal Vin to compare the driving voltage-for-sensing deterioration EVDD2 and the lowest value of the driving voltage-for-sensing deterioration EVDD2 Low. As a result of the comparison, if the driving voltage-for-sensing deterioration EVDD2 is lower than the lowest value of the driving voltage-for-sensing deterioration EVDD2 Low, a high-level output signal is transferred to the first low-pass filter 330. If the driving voltage-for-sensing deterioration EVDD2 is higher than the lowest value of the driving voltage-for-sensing deterioration EVDD2 Low, a low-level output signal is transferred to the first low-pass filter 330. In this regard, the first comparator 310 may be provided as an OP amplifier, the driving voltage-for-sensing deterioration EVDD2 may be supplied to the inverting input terminal (−), and the lowest value of the driving voltage-for-sensing deterioration EVDD2 Low may be applied to the non-inverting input terminal (+) as the reference voltage.

The second comparator 320 receives the driving voltage-for-sensing deterioration EVDD2 as the input signal Vin to compare the driving voltage-for-sensing deterioration EVDD2 and the highest value of the driving voltage-for-sensing deterioration EVDD2 High. As a result of the comparison, if the driving voltage-for-sensing deterioration EVDD2 is higher than the highest value of the driving voltage-for-sensing deterioration EVDD2 High, a high-level output signal is transferred to the second low-pass filter 340. If the driving voltage-for-sensing deterioration EVDD2 is lower than the highest value of the driving voltage-for-sensing deterioration EVDD2 High, a low-level output signal is transferred to the second low-pass filter 340. In this regard, the second comparator 320 may be provided as an OP amplifier, the driving voltage-for-sensing deterioration EVDD2 may be supplied to the non-inverting input terminal (+), and the highest value of the driving voltage-for-sensing deterioration EVDD2 High may be supplied to the inverting input terminal (−).

In a case in which the driving voltage-for-sensing deterioration EVDD2 is about 10V, the reference range of variation of the driving voltage-for-sensing deterioration EVDD2 may be set or selected to a range, for example, from about −0.2V to +0.2V in order to maintain the ratio of variation of the sensing voltage Vsen within about 5%. However, other ratio may be utilized based on various chosen designs. In this case, since the reference range of variation of the driving voltage-for-sensing deterioration EVDD2 is from about 10V−0.2V to about 10V+0.2V, the lowest value of the driving voltage-for-sensing deterioration EVDD2 Low is about 9.8V, while the highest value of the driving voltage-for-sensing deterioration EVDD2 High is about 10.2V. Accordingly, the driving voltage sensing circuit 300 may be configured to determine a case, in which the driving voltage-for-sensing deterioration EVDD2 ranges from about 9.8V to 10.2V, to be normal, and a case, in which the driving voltage-for-sensing deterioration EVDD2 is lower than about 9.8V or higher than about 10.2V, to be abnormal, and provide the result to the timing controller 140.

In this regard, in the first comparator 310 of the driving voltage sensing circuit 300, about 9.8V may be applied to the non-inverting input terminal (+) as the lowest value of the driving voltage-for-sensing deterioration EVDD2 Low, and the driving voltage-for-sensing deterioration EVDD2 may be applied to the inverting input terminal (−) as the input signal Vin. In addition, in the second comparator 320, about 10.2V may be applied to the inverting input terminal (−) as the highest value of the driving voltage-for-sensing deterioration EVDD2 High, and the driving voltage-for-sensing deterioration EVDD2 may be applied to the non-inverting input terminal (+) as the input signal Vin.

In a case in which the driving voltage-for-sensing deterioration EVDD insignificantly fluctuates due to an external reason, such as noise, or the like, the first low-pass filter 330 and the second low-pass filter 340 may serve to remove resultant noise. Accordingly, the first low-pass filter 330 may transfer a first driving voltage sensing signal Vesen1, produced by removing noise from a signal output from the first comparator 310, to the timing controller 140, while the second low-pass filter 340 may transfer a second driving voltage sensing signal Vesen2, produced by removing noise from a signal output from the second comparator 320, to the timing controller 140.

Here, the first low-pass filter 330 and the second low-pass filter 340, connected to the output terminals of the first comparator 310 and the second comparator 320, may be omitted from the driving voltage sensing circuit 300, as required.

The timing controller 140 may control the driving voltage-for-sensing deterioration EVDD2, supplied by the power management IC 210, to be increased or decreased, in response to the first driving voltage sensing signal Vesen1 and the second driving voltage sensing signal Vesen2 transferred from the driving voltage sensing circuit 300.

For example, if the first driving voltage sensing signal Vesen1, transferred from the driving voltage sensing circuit 300, is in a high level, the timing controller 140 may determine the driving voltage-for-sensing deterioration EVDD2 to be lower than the lowest value of the driving voltage-for-sensing deterioration EVDD2 Low, and control the driving voltage-for-sensing deterioration EVDD2, supplied by the power management IC 210, to be increased. Here, the increment by which the power management IC 210 increases the driving voltage-for-sensing deterioration EVDD2 may be set to a specific unit, for example, 0.1V. After the driving voltage-for-sensing deterioration EVDD2 is increased one time, if the first driving voltage sensing signal Vesen1 is in the high level, the driving voltage-for-sensing deterioration EVDD2 may be additionally increased.

Here, a register may be additionally provided on the output terminal of the first low-pass filter 330 in order to provide a time interval in which a change in the driving voltage-for-sensing deterioration EVDD2 can be identified after the timing controller 140 has controlled the power management IC 210 to increase the driving voltage-for-sensing deterioration EVDD2.

In addition, in a case in which the second driving voltage sensing signal Vesen2, transferred from the driving voltage sensing circuit 300, is in a high level, the driving voltage-for-sensing deterioration EVDD2 may be determined to be higher than the highest value of the driving voltage-for-sensing deterioration EVDD2 High. The timing controller 140 may control the driving voltage-for-sensing deterioration EVDD2, output from the power management IC 210, to be decreased. Here, the increment by which the power management IC 210 decreases the driving voltage-for-sensing deterioration EVDD2 may be set to a specific unit, for example, about 0.1V. After the driving voltage-for-sensing deterioration EVDD2 is decreased one time, if the second driving voltage sensing signal Vesen2 is in the high level, the driving voltage-for-sensing deterioration EVDD2 may be additionally decreased.

Here, a register may be additionally provided on the output terminal of the second low-pass filter 340 in order to provide a time interval in which a change in the driving voltage-for-sensing deterioration EVDD2 can be identified after the timing controller 140 has controlled the power management IC 210 to decrease the driving voltage-for-sensing deterioration EVDD2.

In contrast, both the first driving voltage sensing signal Vesen1 and the second driving voltage sensing signal Vesen2 are in low levels, the driving voltage-for-sensing deterioration EVDD2 may be determined within the reference range, and the timing controller 140 may not separately control the driving voltage-for-sensing deterioration EVDD2 output from the power management IC 210.

Figure 14A:
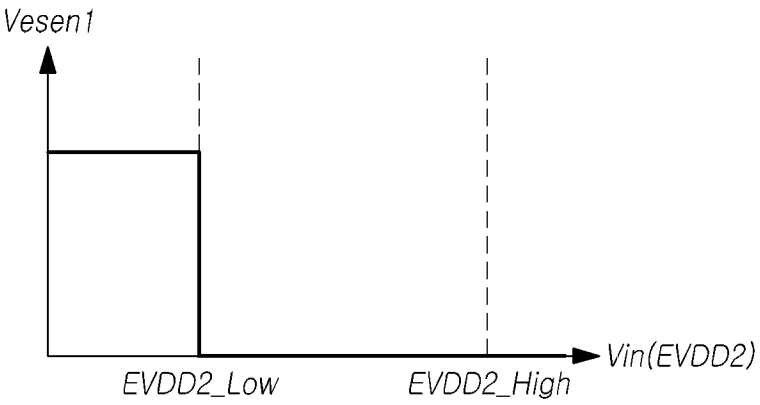
FIGS. 14A and 14B illustrate changes in a driving voltage sensing signal in response to input signals in the driving voltage sensing circuit according to one or more embodiments.
Figure 14B:
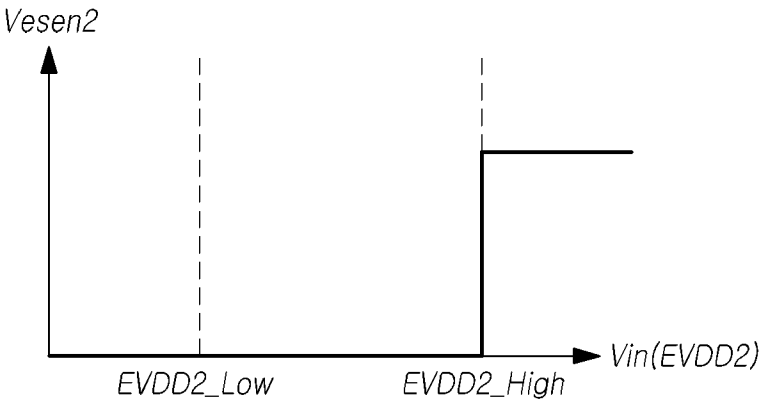

FIGS. 14A and 14B illustrate changes in a driving voltage sensing signal in response to input signals in the driving voltage sensing circuit according to one or more embodiments.

Referring to FIG. 14A, the first comparator 310 may compare the driving voltage-for-sensing deterioration EVDD2 and the lowest value of the driving voltage-for-sensing deterioration EVDD2 Low, output a high-level signal if the driving voltage-for-sensing deterioration EVDD2 is lower than the lowest value of the driving voltage-for-sensing deterioration EVDD2 Low, and output a low-level signal if the driving voltage-for-sensing deterioration EVDD2 is higher than the lowest value of the driving voltage-for-sensing deterioration EVDD2 Low. Accordingly, as illustrated in FIG. 14A, the first driving voltage sensing signal Vesen1 may remain in the high level in a range in which the first driving voltage sensing signal Vesen1 is lower than first driving voltage sensing signal Vesen1 while remaining in the low level in the remaining ranges.

The second comparator 320 may compare the driving voltage-for-sensing deterioration EVDD2 and the highest value of the driving voltage-for-sensing deterioration EVDD2 High, output a high-level signal if the driving voltage-for-sensing deterioration EVDD2 is higher than the highest value of the driving voltage-for-sensing deterioration EVDD2 High, and output a low-level signal if the driving voltage-for-sensing deterioration EVDD2 is lower than the highest value of the driving voltage-for-sensing deterioration EVDD2 High. Accordingly, as illustrated in FIG. 14B, the second driving voltage sensing signal Vesen2 may remain in the high level in a range in which the second driving voltage sensing signal Vesen2 is lower than first driving voltage sensing signal Vesen1 while remaining in the low level in the remaining ranges.

Accordingly, the timing controller 140 may determine the driving voltage-for-sensing deterioration EVDD2 to be outside of the reference range if the first driving voltage sensing signal Vesen1 or the second driving voltage sensing signal Vesen2, output from the driving voltage sensing circuit 300, is determined to be in the high level, and control the power management IC 210 depending on which of the first driving voltage sensing signal Vesen1 or the second driving voltage sensing signal Vesen2 is in the high level, so that the driving voltage-for-sensing deterioration EVDD2 can be adjusted within the reference range.

As a result, the display device 100 according to one or more embodiments can maintain the driving voltage-for-sensing deterioration EVDD2 within the reference range, thereby accurately sense the deterioration of the organic light-emitting diode OLED.

The foregoing descriptions and the accompanying drawings have been presented in order to explain certain principles of the present disclosure by way of example. A person having ordinary skill in the art to which the present disclosure relates could make various modifications and variations without departing from the principle of the present disclosure. The foregoing embodiments disclosed herein shall be interpreted as being illustrative, while not being limitative, of the principle and scope of the present disclosure.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel including a plurality of gate lines, a plurality of data lines, and a plurality of subpixels formed adjacent to overlapping locations of the gate lines and the data lines;

a gate driver circuit driving the plurality of gate lines;

a data driver circuit driving the plurality of data lines;

a power management integrated circuit configured to supply a driving voltage-for-sensing deterioration to the display panel;

a driving voltage sensing circuit configured to:

sense whether or not the driving voltage-for-sensing deterioration supplied to the display panel is outside of a reference range; and output a driving voltage sensing signal according to a result of the sensing; and a timing controller controlling a supply of the driving voltage-for-sensing deterioration by the power management integrated circuit, in response to the driving voltage sensing signal transferred from the driving voltage sensing circuit, wherein the driving voltage sensing circuit for sensing the driving voltage-for-sensing deterioration is supplied to the display panel in a deterioration sensing period in which deterioration of a plurality of organic light-emitting diodes of the display panel is sensed;

wherein the driving voltage sensing circuit includes:

a switch allowing the driving voltage-for-sensing deterioration to be supplied as an input signal in the deterioration sensing period;

a first comparator including an operational amplifier, wherein the driving voltage-for-sensing deterioration is supplied to an inverting input terminal of the first comparator through the switch, and the lowest value of the driving voltage-for-sensing deterioration is supplied to a non-inverting input terminal of the first comparator;

a second comparator including an operational amplifier, wherein the driving voltage-for-sensing deterioration is supplied to a non-inverting input terminal of the second comparator, and the highest value of the driving voltage-for-sensing deterioration is supplied to an inverting input terminal of the second comparator;

a first low-pass filter coupled to an output terminal of the first comparator to transfer a first driving voltage sensing signal from the first comparator to the timing controller; and a second low-pass filter coupled to an output terminal of the second comparator to transfer a second driving voltage sensing signal from the second comparator to the timing controller.

2. The display device according to claim 1, wherein each of the plurality of subpixels comprises:

an organic light-emitting diode;

a driving transistor driving the organic light-emitting diode, and having the driving voltage-for-sensing deterioration applied thereto, the driving transistor including a source node, a gate node, and a drain node;

a switching transistor electrically connected between the gate node of the driving transistor and a corresponding data line among the plurality of data lines; and a sensing transistor electrically connected between either the source node or the drain node of the driving transistor and a reference voltage line.

3. The display device according to claim 1, wherein the reference range corresponds to a range between a highest value of the driving voltage-for-sensing deterioration and a lowest value of the driving voltage-for-sensing deterioration, which are determined in consideration of accurately sensing the deterioration of the organic light-emitting diode within the display panel.

4. The display device according to claim 1, further comprising:

a first register connected to the output terminal of the first low-pass filter; and a second register connected to the output terminal of the second low-pass filter.

5. The display device according to claim 1, wherein the timing controller is further configured to:

control the power management integrated circuit to increase the driving voltage-for-sensing deterioration if the first driving voltage sensing signal is in a logic high level; and control the power management integrated circuit to decrease the driving voltage-for-sensing deterioration if the second driving voltage sensing signal is in a logic high level.

6. A driving voltage sensing circuit sensing a driving voltage supplied in a deterioration sensing period in which deterioration of a plurality of organic light-emitting diodes of a display panel is sensed, the driving voltage sensing circuit comprising:

a switch allowing the driving voltage to be supplied as an input signal in the deterioration sensing period;

a first comparator including an operational amplifier, wherein the driving voltage is supplied to an inverting input terminal of the operational amplifier through the switch, and a lowest value of the driving voltage is supplied to a non-inverting input terminal of the first comparator;

a second comparator including an operational amplifier, wherein the driving voltage is applied to a non-inverting input terminal of the second comparator, and a highest value of the driving voltage is supplied to an inverting input terminal of the second comparator;

a first low-pass filter coupled to an output terminal of the first comparator to transfer a first driving voltage sensing signal from the first comparator to the timing controller; and a second low-pass filter coupled to an output terminal of the second comparator to transfer a second driving voltage sensing signal from the second comparator to the timing controller.

7. The driving voltage sensing circuit according to claim 6, further comprising:

a first register connected to the output terminal of the first low-pass filter; and a second register connected to the output terminal of the second low-pass filter.

8. A display device, comprising:

a power management integrated circuit configured to supply a driving voltage-for-sensing deterioration to a driving voltage sensing circuit;

the driving voltage sensing circuit configured to:

sense whether or not the driving voltage-for-sensing deterioration received is outside of a reference range; and output a driving voltage sensing signal according to a result of the sensing; and a timing controller electrically coupled to the driving voltage sensing circuit, wherein the driving voltage sensing circuit includes:

a first comparator including a first operational amplifier having an output terminal, an inverting input terminal and a non-inverting input terminal;

a second comparator including a second operational amplifier having an output terminal, an inverting input terminal and a non-inverting input terminal;

a switch capable of selectively providing a sensing driving voltage, wherein one end of the switch is commonly connected to the inverting input terminal of the first comparator and the non-inverting input terminal of the second comparator, wherein the sensing driving voltage ranging between a lowest value and a highest value;

a first low-pass filter coupled to the output terminal of the first comparator; and a second low-pass filter coupled to the output terminal of the second comparator, wherein the lowest value of the sensing driving voltage is supplied to the non-inverting input terminal of the first comparator, and the highest value of the sensing driving voltage is supplied to the inverting input terminal of the second comparator.

9. The display device according to claim 8, wherein the first comparator is configured to compare the lowest value of the sensing driving voltage and the sensing driving voltage, and the second comparator is configured to compare the highest value of the sensing driving voltage and the sensing driving voltage.

10. The display device according to claim 9, wherein the first comparator outputs a logic high-level signal if the sensing driving voltage is less than the lowest value of the sensing driving voltage, and outputs a logic low-level output if the sensing driving voltage is greater than the lowest value of the sensing driving voltage, wherein the second comparator outputs a logic high-level signal if the sensing driving voltage is greater than the highest value of the sensing driving voltage, and outputs a logic low-level output if the sensing driving voltage is less than the highest value of the sensing driving voltage.

11. The display device according to claim 10, wherein the timing controller is configured to:

determine whether the sensing driving voltage is less than the lowest value of the sensing driving voltage; and in response to determining the sensing driving voltage is less than the lowest value of the sensing driving voltage, control the sensing driving voltage supplied by the power management integrated circuit to be increased.

12. The display device according to claim 10, wherein the timing controller is configured to:

determine whether the sensing driving voltage is greater than the highest value of the sensing driving voltage; and in response to determining the sensing driving voltage is greater than the highest value of the sensing driving voltage, control the sensing driving voltage supplied by the power management integrated circuit to be decreased.

13. The display device according to claim 8, wherein the switch is configured to operate at image driving period and a deterioration sensing period, wherein the switch is electrically disconnected at the image driving period and electrically connected at the deterioration sensing period to provide the sensing driving voltage.

* * * * *